US012780267B2

(12) United States Patent
Hirano et al.

(10) Patent No.: US 12,780,267 B2
(45) Date of Patent: Nov. 3, 2026

(54) STRADDLE TYPE MONORAIL VEHICLE AND ASSEMBLY METHOD THEREOF

(71) Applicant: Hitachi, Ltd., Tokyo (JP)

(72) Inventors: Shuji Hirano, Tokyo (JP); Kazuya Furuta, Tokyo (JP); Yoshiyuki Hagihara, Tokyo (JP); Meichuan Chen, Tokyo (JP)

(73) Assignee: HITACHI, LTD., Tokyo (JP)

( * ) Notice: Subject to any disclaimer, the term of this patent is extended or adjusted under 35 U.S.C. 154(b) by 461 days.

(21) Appl. No.: 18/371,687

(22) Filed: Sep. 22, 2023

(65) Prior Publication Data

US 2024/0116546 A1 Apr. 11, 2024

(30) Foreign Application Priority Data

Oct. 7, 2022 (JP) ..... 2022-162342

(51) Int. Cl.

| | |
|---|---|
| ***B61B 13/06*** | (2006.01) |
| ***B61B 13/04*** | (2006.01) |
| ***B61F 5/16*** | (2006.01) |
| ***B61F 5/18*** | (2006.01) |
| ***B61F 5/52*** | (2006.01) |

(52) U.S. Cl.

CPC ..... *B61B 13/06* (2013.01); *B61B 13/04* (2013.01); *B61F 5/16* (2013.01); *B61F 5/18* (2013.01); *B61F 5/52* (2013.01)

(58) Field of Classification Search

CPC . B61B 13/06; B61B 13/04; B61F 5/16; B61F 5/18; B61F 5/52

USPC ..... 104/89, 93

See application file for complete search history.

(56) References Cited

U.S. PATENT DOCUMENTS 1,751,065 A * 3/1930 Alden ..... B61F 5/16 105/201
2004/0261653 A1* 12/2004 Coslovi ..... B61F 5/16 105/199.4
2017/0320503 A1* 11/2017 Kato ..... B61D 17/048

(Continued)

FOREIGN PATENT DOCUMENTS

CN 204264159 U * 4/2015
CN 107264558 A * 10/2017 ..... B61F 5/16
DE 2343121 A1 * 3/1975

(Continued)

*Primary Examiner* — S. Joseph Morano
*Assistant Examiner* — James William Jones
(74) *Attorney, Agent, or Firm* — MATTINGLY & MALUR, PC

(57) ABSTRACT

Provided are a straddle type monorail vehicle in which a center pin provided in a vehicle body can be mechanically fastened to a center pin holding portion provided in a bogie via a cushioning rubber with a small number of work steps, and an assembly method thereof. The center pin has a hollow shape in which both ends are opened, and includes a large cylindrical portion on a bolster beam side and a small cylindrical portion that is connected to the large cylindrical portion and that is coaxial with the large cylindrical portion, the center pin holding portion is elastically supported by a bogie frame forming a frame body of the bogie, and has a hollow portion into which the small cylindrical portion of the center pin is inserted. A fixing metal fitting has a cylindrical rod shape inserted through the center pin that includes first and second threaded portions.

8 Claims, 6 Drawing Sheets

(56) References Cited

U.S. PATENT DOCUMENTS

2018/0345996 A1* 12/2018 Zhou ..... B61B 13/06

FOREIGN PATENT DOCUMENTS

| | | | | | |
|---|---|---|---|---|---|
| JP | 2001151102 | A | * | 6/2001 | |
| JP | 2013189097 | A | * | 9/2013 | ..... B61B 13/04 |
| JP | 2019059303 | A | * | 4/2019 | |
| WO | WO-2014076788 | A1 | * | 5/2014 | ..... B61F 5/18 |

* cited by examiner

STRADDLE TYPE MONORAIL VEHICLE AND ASSEMBLY METHOD THEREOF

CROSS-REFERENCE TO RELATED APPLICATIONS

The present application claims priority to Japanese Patent Application No. 2022-162342, filed Oct. 7, 2022. The contents of this application are incorporated herein by reference in their entirety.

TECHNICAL FIELD

The present invention relates to a straddle type monorail vehicle and an assembly method thereof.

BACKGROUND ART

For a straddle type monorail, a straddle type monorail bogie has been studied which can facilitate handling by reducing a weight and a size of an axle and a drive apparatus, and which can facilitate maintenance including wheel replacement during tire puncture or the like.

PTL 1 discloses a straddle type monorail bogie including a drive apparatus that is low in cost and that has a reduced size and a reduced weight. Specifically, PTL 1 discloses the straddle type monorail bogie including: a drive apparatus including a traveling wheel, a speed reducer coupled to the traveling wheel, and a main electric motor connected to the speed reducer in a power transmittable manner; and a bogie frame that holds the drive apparatus, in which the drive apparatus includes a configuration in which the drive apparatus is sandwiched by a lower restraint portion fixed to the bogie frame and an upper restraint portion fastened to the lower restraint portion, and the drive apparatus is attached to the bogie frame.

CITATION LIST

Patent Literature

PTL 1: JP2019-059303A

SUMMARY OF INVENTION

Technical Problem

A straddle type monorail vehicle generally includes a vehicle body on which a passenger or the like rides and that includes an underfloor device, and a bogie that supports the vehicle body and that travels along a track beam. A step of connecting the vehicle body to the bogie is necessary during a manufacturing process of the straddle type monorail vehicle or after the bogie or the like is separated from the vehicle body in order to repair or inspect the bogie or the like. The bogie is connected to the vehicle body in a mode in which a center pin provided in a mode of being suspended from an underframe constituting a floor surface of the vehicle body is housed in a space in a central portion of the bogie frame constituting the bogie such that the bogie can turn in a horizontal plane along a curvature of the laid track beam.

The bogie including the main electric motor that generates a drive force and the brake apparatus that generates a deceleration force transmits acceleration and deceleration forces in a front-rear direction to the vehicle body via the center pin. Further, the bogie and the vehicle body are connected to each other via cushioning rubbers and dampers such that a vibration in a left-right direction generated in the bogie is not transmitted to the vehicle body when passing a branch apparatus or the like provided on the track beam.

Therefore, the bogie is fixed to the vehicle body by connecting a center pin holding portion (see FIG. 3) having a function of preventing transmission of vibrations in a front-rear direction and a left-right direction and provided in the bogie to the center pin provided in the vehicle body.

The center pin holding portion provided in the bogie has, in a central portion thereof, a gap in which a tip end portion of the center pin is housed. When connecting the vehicle body to the bogie, after the vehicle body suspended by a crane or the like is slowly lowered onto the bogie, the center pin holding portion provided in the bogie and the center pin provided in the vehicle body are connected to each other by a fixing metal fitting.

However, since the center pin holding portion and the center pin are mechanically connected to each other in a state of being via the cushioning rubbers, in a situation in which it is difficult to directly observe a deflection situation of the cushioning rubbers, it is necessary to carefully mechanically fasten the center pin holding portion to the center pin, and the number of steps of connecting the vehicle body to the bogie tends to increase in order to confirm that a predetermined axial force is generated at a mechanically fastened portion.

An object of the invention is to provide a straddle type monorail vehicle in which a center pin provided in a vehicle body can be mechanically fastened to a center pin holding portion provided in a bogie via a cushioning rubber with a small number of work steps, and an assembly method thereof.

Solution to Problem

In order to solve the problems described above, a representative typical straddle type monorail vehicle according to the invention includes:

- a vehicle body including a center pin fixed in a mode of being suspended from a bolster beam forming a floor portion;
- a bogie including a center pin holding portion into which a lower end portion of the center pin is inserted in order to support the vehicle body; and
- a fixing metal fitting, a lower metal fitting, and an upper metal fitting configured to fasten the center pin to the center pin holding portion, in which
- the center pin has a hollow shape in which both ends are opened, and includes a large cylindrical portion on a bolster beam side and a small cylindrical portion that is connected to the large cylindrical portion and that is coaxial with the large cylindrical portion,
- the center pin holding portion is elastically supported by a bogie frame forming a frame body of the bogie, and has a hollow portion into which the small cylindrical portion of the center pin is inserted,
- the fixing metal fitting has a cylindrical rod shape inserted through the center pin, includes a first threaded portion at an upper end portion thereof, and includes a second threaded portion at a stepped portion formed at a lower end portion thereof,
- the lower metal fitting is disposed below the center pin holding portion, and has a female threaded hole to be threadedly engaged with the second threaded portion, the upper metal fitting is placed on an upper end surface of the center pin, and has a hole through which the first threaded portion penetrates, and in a state in which the second threaded portion is threadedly engaged with the female threaded hole and the lower metal fitting abuts against the stepped portion, the lower metal fitting is biased toward a lower end of the center pin and the upper metal fitting is biased toward an upper end of the center pin by threadedly engaging a nut with the first threaded portion that penetrates through the hole.

Advantageous Effects of Invention

According to the invention, it is possible to provide a straddle type monorail vehicle in which a center pin provided in a vehicle body can be mechanically fastened to a center pin holding portion provided in a bogie via a cushioning rubber with a small number of work steps, and an assembly method thereof.

Problems, configurations, and effects other than those described above will be apparent by the following description of the embodiment.

DESCRIPTION OF EMBODIMENTS

Hereinafter, an embodiment of a straddle type monorail vehicle and a method for fastening a vehicle body to bogies thereof according to the embodiment of the present invention will be described with reference to the drawings.

First, directions when describing the embodiment will be defined. A longitudinal direction of the straddle type monorail vehicle body or the bogie (a longitudinal direction of a track beam) is an x direction, a width direction of the straddle type monorail vehicle body or the bogie (a horizontal direction intersecting the track beam) is a y direction, and a height direction of the straddle type monorail vehicle body or the bogie is a z direction. Hereinafter, the directions may be simply referred to as the x direction, the y direction, and the z direction.

Figure 1:
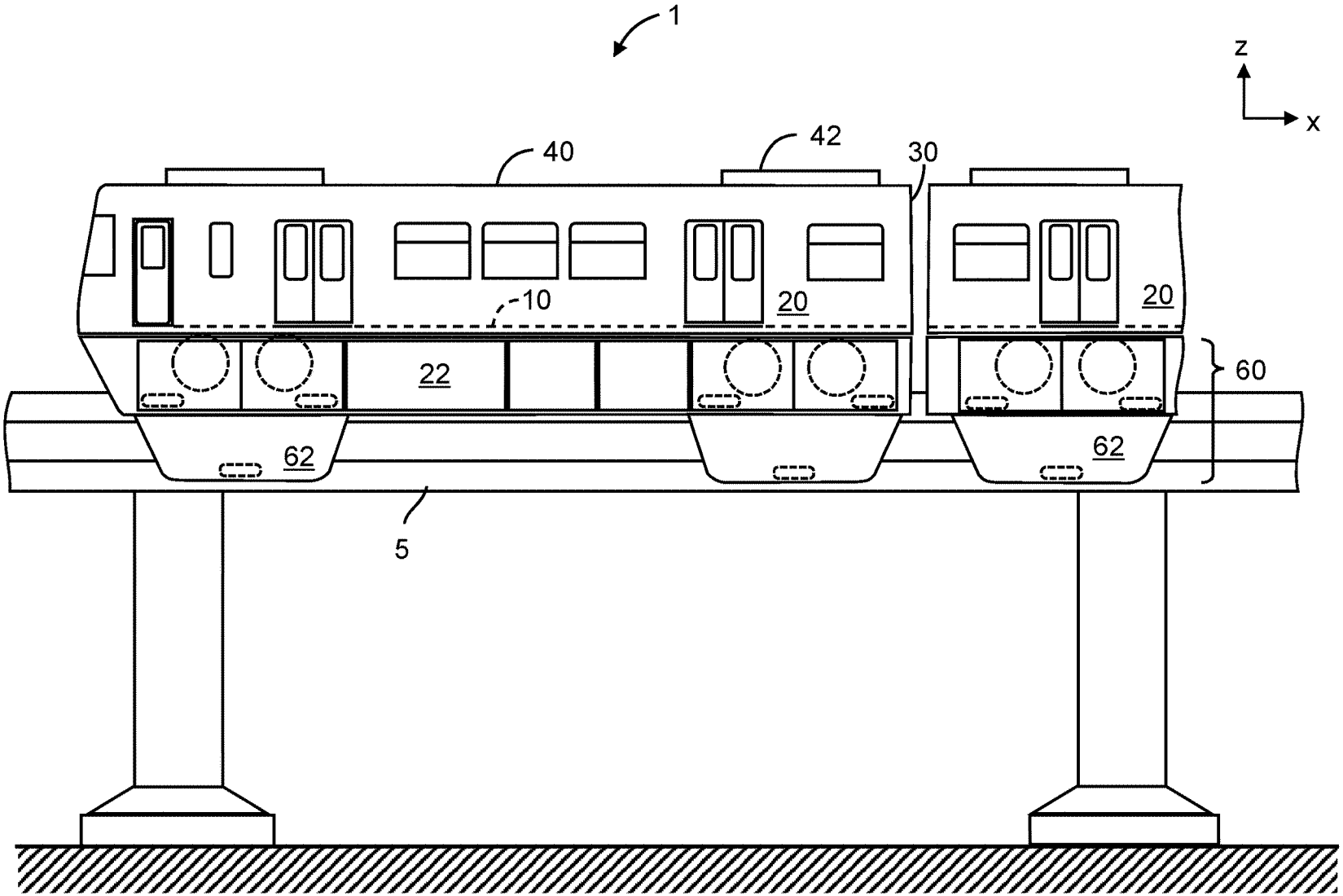
FIG. 1 is a side view of a straddle type monorail vehicle according to the present embodiment.

FIG. 1 is a side view of the straddle type monorail vehicle according to the present embodiment. A straddle type monorail vehicle 1 (hereinafter, referred to as a vehicle 1) includes bogies 60 provided in a mode in which a track beam 5 is straddled and a vehicle body supported by the bogies 60. The vehicle body includes an underframe 10 that constitutes a floor surface, side structures 20 erected on both end portions of the underframe 10 in the y direction, an end structure 30 erected on an end portion of the underframe 10 in the x direction, and a roof structure 40 placed on upper end portions of the side structures 20 and the end structure 30.

The side structure 20 includes window portions, side sliding doors provided when a passenger or the like gets on or off, and the like. The roof structure 40 includes, on an upper surface thereof, an air-conditioning device 42 that generates conditioned air to supply the conditioned air to the vehicle body.

A lower portion of the underframe 10 that constitutes the floor surface of the vehicle body includes underfloor devices such as a main conversion apparatus that supplies power to a main electric motor provided in the bogie 60, and an air compressor that generates compressed air to be supplied to a brake apparatus, a door engine that drives the side sliding door, and the like. Sides of the underfloor devices and the bogies 60 are covered by side skirts 22. A vicinity of the bogie 60 is covered by bogie covers 62 that further extend downward from the side skirts 22.

Figure 2:
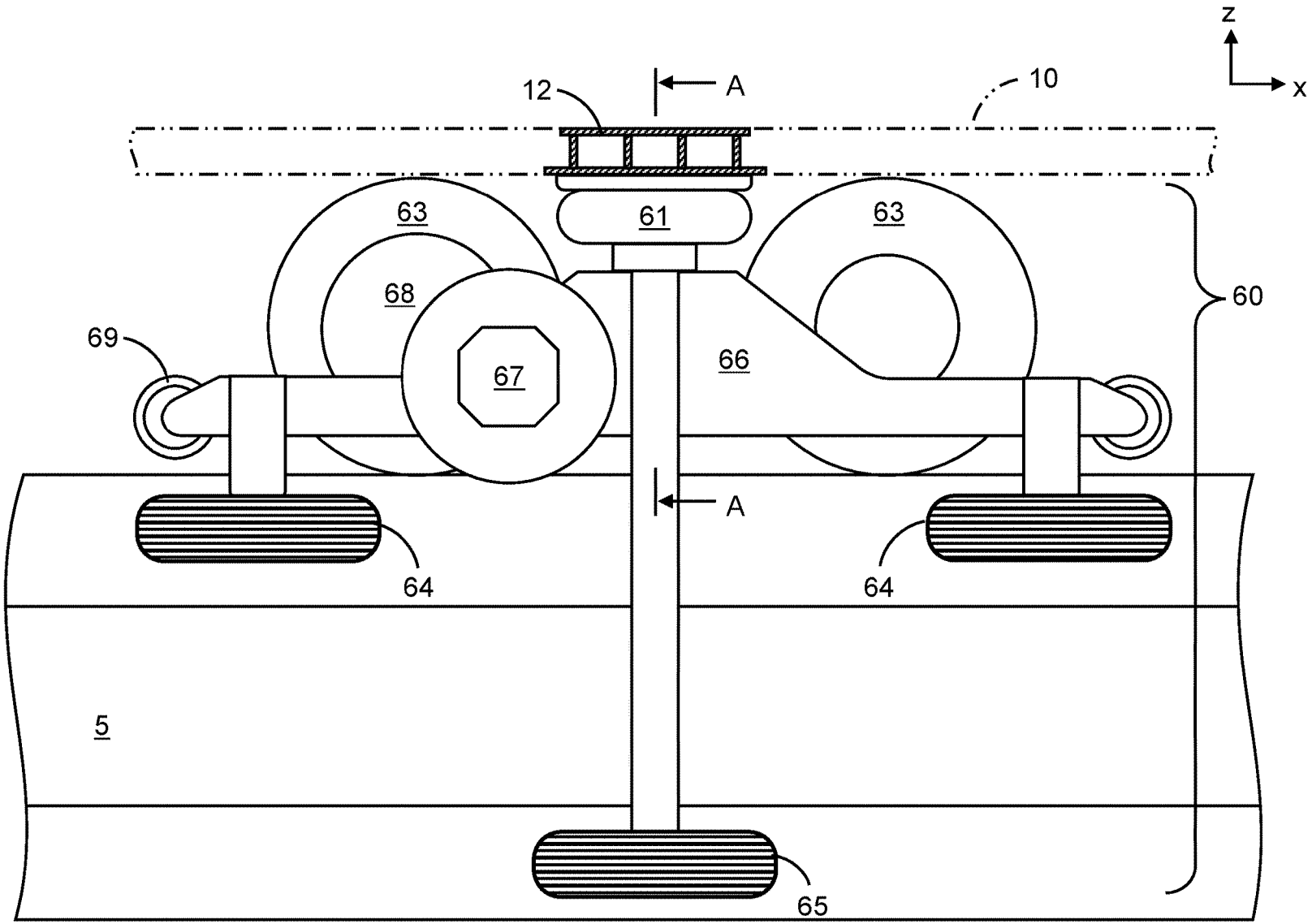
FIG. 2 is a side view of a bogie that supports a vehicle body of a straddle type monorail according to the present embodiment.

FIG. 2 is a side view of the bogie that supports the straddle type monorail vehicle body, and shows the bogie in a state in which the side skirts 22 and the bogie covers 62 are removed. The bogie 60 includes a bogie frame 66 including traveling wheels 63 that roll on an upper surface of the track beam 5, guide wheels 64 that roll on an upper side surface of the track beam 5 in a horizontal plane, and a stabilization wheel 65 that rolls on a lower side surface of the track beam 5 in a horizontal plane. The bogie frame 66 includes a main electric motor 67 that drives the traveling wheels 63, a speed reducer 68 interposed between the main electric motor 67 and the traveling wheels 63, a brake apparatus (not shown), and the like.

A central portion of the bogie frame 66 in the x direction includes an air spring 61 that elastically supports the vehicle body. The air spring 61 supports a bolster beam 12 provided in the underframe 10 that constitutes the floor surface of the vehicle body.

Figure 3:
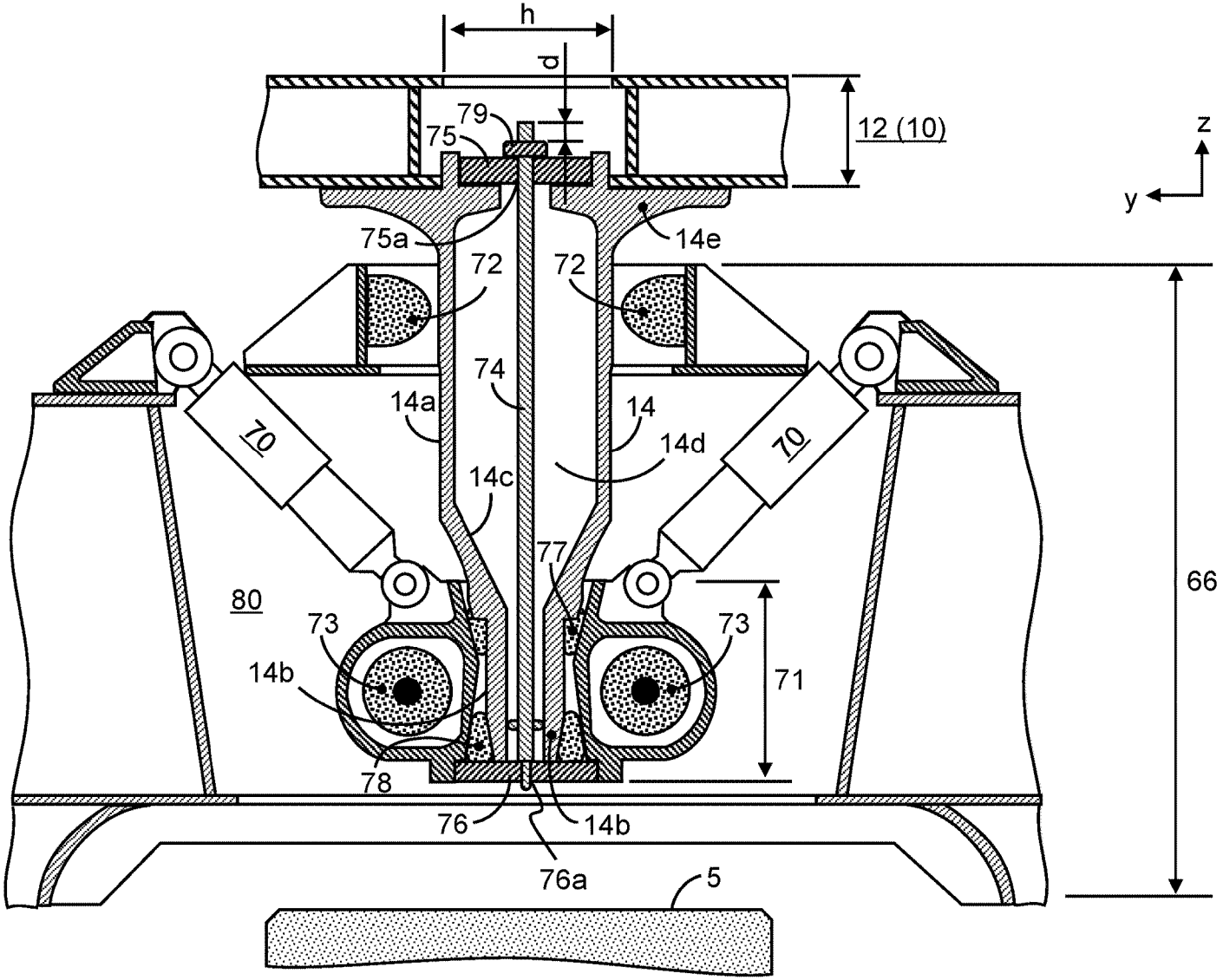
FIG. 3 is a cross-sectional view (a cross-sectional view taken along a line A-A in FIG. 2) of a central portion of the bogie in a longitudinal direction.
Figure 4:
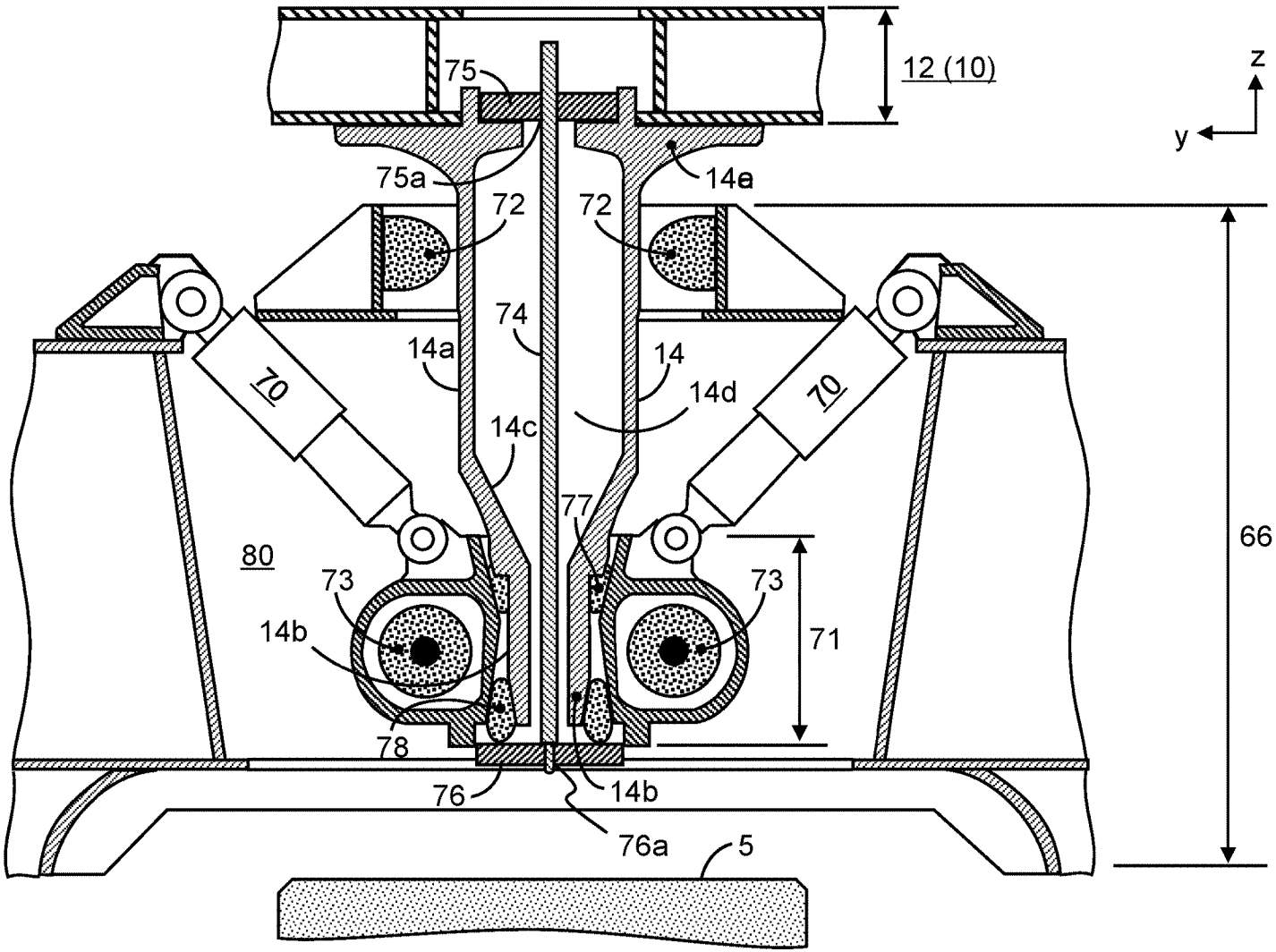
FIG. 4 is a cross-sectional view (corresponding to a cross-sectional view taken along a line A-A in FIG. 2) showing a state immediately before a center pin provided in the vehicle body is fixed to a center pin holding portion provided in the bogie.
Figure 5:
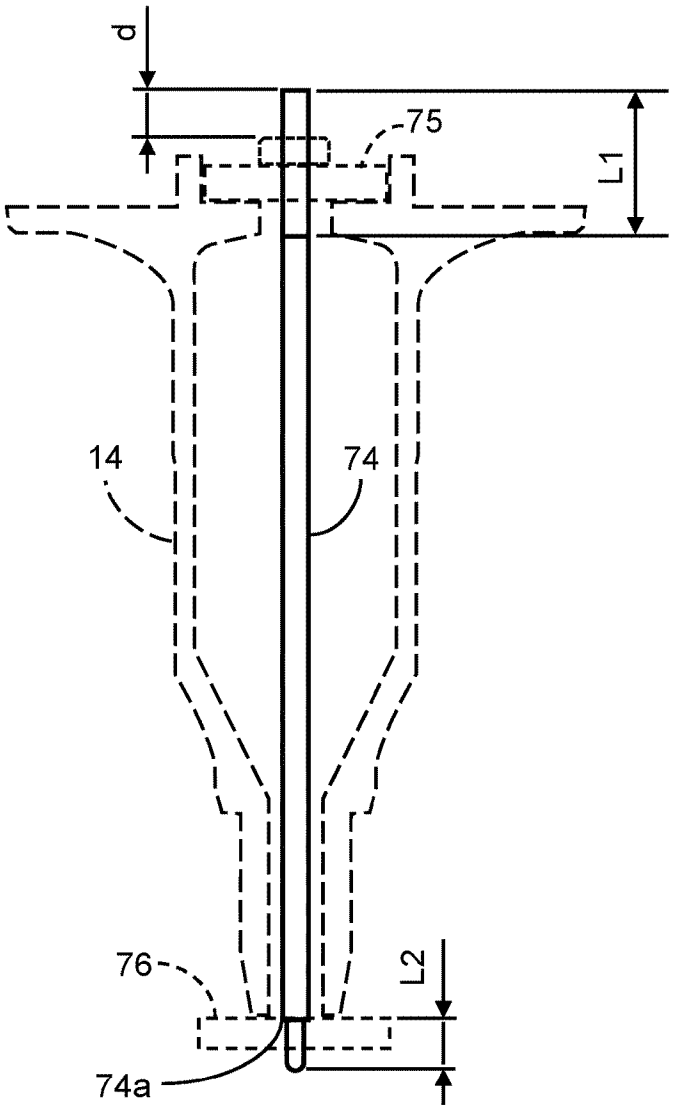
FIG. 5 is a detailed view of a fixing metal fitting that connects the center pin provided in the vehicle body to the center pin holding portion provided in the bogie.

FIG. 3 is a cross-sectional view (a cross-sectional view taken along a line A-A in FIG. 2) of a central portion of the bogie in a longitudinal direction. FIG. 4 is a cross-sectional view (corresponding to a cross-sectional view taken along a line A-A in FIG. 2) showing a state immediately before a center pin provided in the vehicle body is fixed to a center pin holding portion provided in the bogie. FIG. 5 is a detailed view of a fixing metal fitting that connects the center pin provided in the vehicle body to the center pin holding portion provided in the bogie, and shows the center pin and the like by a dotted line.

The bogie frame 66 is a frame body that supports the traveling wheels 63, the guide wheels 64, and the stabilization wheel 65, and that includes the main electric motor 67 that drives the traveling wheels 63, the speed reducer 68 that reduces a rotational speed of the main electric motor 67 to transmit a driving force to the traveling wheels 63, and the like.

In a space 80 in a central portion of the bogie frame 66 in the x direction and the y direction, the center pin holding portion 71 elastically supported by the bogie frame 66 is provided. There is a cylindrical space portion having an axis along the z direction in a central portion of the center pin holding portion 71, and a lower end portion of the center pin 14 fixed to the bolster beam 12 of the underframe 10 is inserted into the cylindrical space portion.

Further, the center pin 14 and the center pin holding portion 71 are rigidly coupled to each other by the fixing metal fitting 74 that penetrates a hollow portion of the center pin 14 suspended and fixed to the bolster beam 12 constituting a floor portion and that is inserted into the lower end portion of the center pin holding portion 71 in a state in which annular or tubular elastically deformable cushioning rubbers 77 and 78 are interposed between the center pin 14 and the center pin holding portion 71.

The center pin holding portion 71 is elastically supported by the bogie frame 66 via front-rear direction cushioning rubbers 73 that alleviate vibration or the like in the x direction due to acceleration or deceleration of the bogie 60, and is connected to the bogie frame 66 via a pair of dampers 70 that alleviate vibration in the z direction likely to be generated when passing a joint of the track beam 5 or the like. The dampers 70 alleviate vibration in the y (left-right) direction between the vehicle body and the bogie 60 in addition to a relative displacement in the z (upper-lower) direction between the vehicle body and the bogie 60. An upper portion of the space 80 in the bogie frame 66 includes a pair of left-right direction cushioning rubbers 72 that alleviate the vibration in y (left-right) direction by abutting against an upper portion of the center pin 14.

The hollow-shaped center pin 14 includes a large cylindrical portion 14*a* including a flange portion 14*e* that supports the bolster beam 12 at an upper end, and includes, at a lower portion thereof, a small cylindrical portion 14*b* that is connected to the large cylindrical portion 14*a* via a tapered portion 14*c* and that is coaxial with the large cylindrical portion 14*a*. The small cylindrical portion 14*b* of the center pin 14 is connected to the center pin holding portion 71. The tapered portion 14*c* has a diameter that decreases downward, and connects a lower end of the large cylindrical portion 14*a* of the center pin 14 to an upper end of the small cylindrical portion 14*b* of the center pin 14. The large cylindrical portion 14*a*, the tapered portion 14*c*, and the small cylindrical portion 14*b* have a common hollow portion 14*d* therein. The rod-shaped fixing metal fitting 74 is provided in a mode of penetrating the hollow portion 14*d* from an upper end portion thereof toward a lower end portion in the z direction.

In FIG. 5, the fixing metal fitting 74 is a cylindrical rod-shaped member, includes a first threaded portion L1 at an upper end portion thereof, and includes a second threaded portion L2 in a mode of protruding from a stepped portion 74*a* provided at a lower end portion thereof. A coarse thread is applied to the first threaded portion L1, and a fine thread is applied to the second threaded portion L2.

In FIGS. 3 and 4, a female threaded hole 76*a* threadedly engaged with the second threaded portion L2 is processed in a central portion of a plate-shaped lower metal fitting 76 pressed against the stepped portion 74*a* at the lower end portion of the fixing metal fitting 74. On the other hand, a central portion of a plate-shaped upper metal fitting 75 assembled to the upper end portion of the fixing metal fitting 74 has a hole 75*a* through which the first threaded portion L1 processed at the upper end portion of the fixing metal fitting 74 penetrates.

During the assembly, the cushioning rubbers 77 and 78 are disposed inside the center pin 14 whose lower end is inserted through the center pin holding portion 71 in advance. Further, the fixing metal fitting 74 is inserted into the center pin 14, and the second threaded portion L2 at the penetrated lower end portion is exposed from the lower end of the center pin 14 while passing through the cushioning rubbers 77 and 78. The lower metal fitting 76 is approached from below the center pin holding portion 71, the second threaded portion L2 is threadedly engaged with the female threaded hole 76*a* formed in the central portion of the lower metal fitting 76, and the second threaded portion L2 is tightened until an upper surface of the lower metal fitting 76 abuts against an end of the stepped portion 74*a*.

Thereafter, assembly is performed such that the upper metal fitting 75 is approached from above the fixing metal fitting 74, and the upper metal fitting 75 is lowered until the upper metal fitting 75 is placed on an upper end surface of the large cylindrical portion 14*a* of the center pin 14 while allowing the first threaded portion L1 to penetrate through the hole 75*a* in the central portion of the upper metal fitting 75. A nut 79 is threadedly engaged with the first threaded portion L1 of the fixing metal fitting 74 exposed from the upper metal fitting 75. Thereafter, the nut 79 is tightened until the upper end portion of the fixing metal fitting 74 protrudes by a dimension d in an axial direction of the upper end portion of the fixing metal fitting 74 from an upper surface of the nut 79.

The fastening between the center pin 14 restrained by the upper metal fitting 75 and the center pin holding portion 71 restrained by the lower metal fitting 76 in a state in which the cushioning rubbers 77 and 78 are interposed is completed by the fastening being performed in a state in which the upper end portion of the fixing metal fitting 74 protrudes by the predetermined dimension d from the upper surface of the nut 79.

Figure 6:
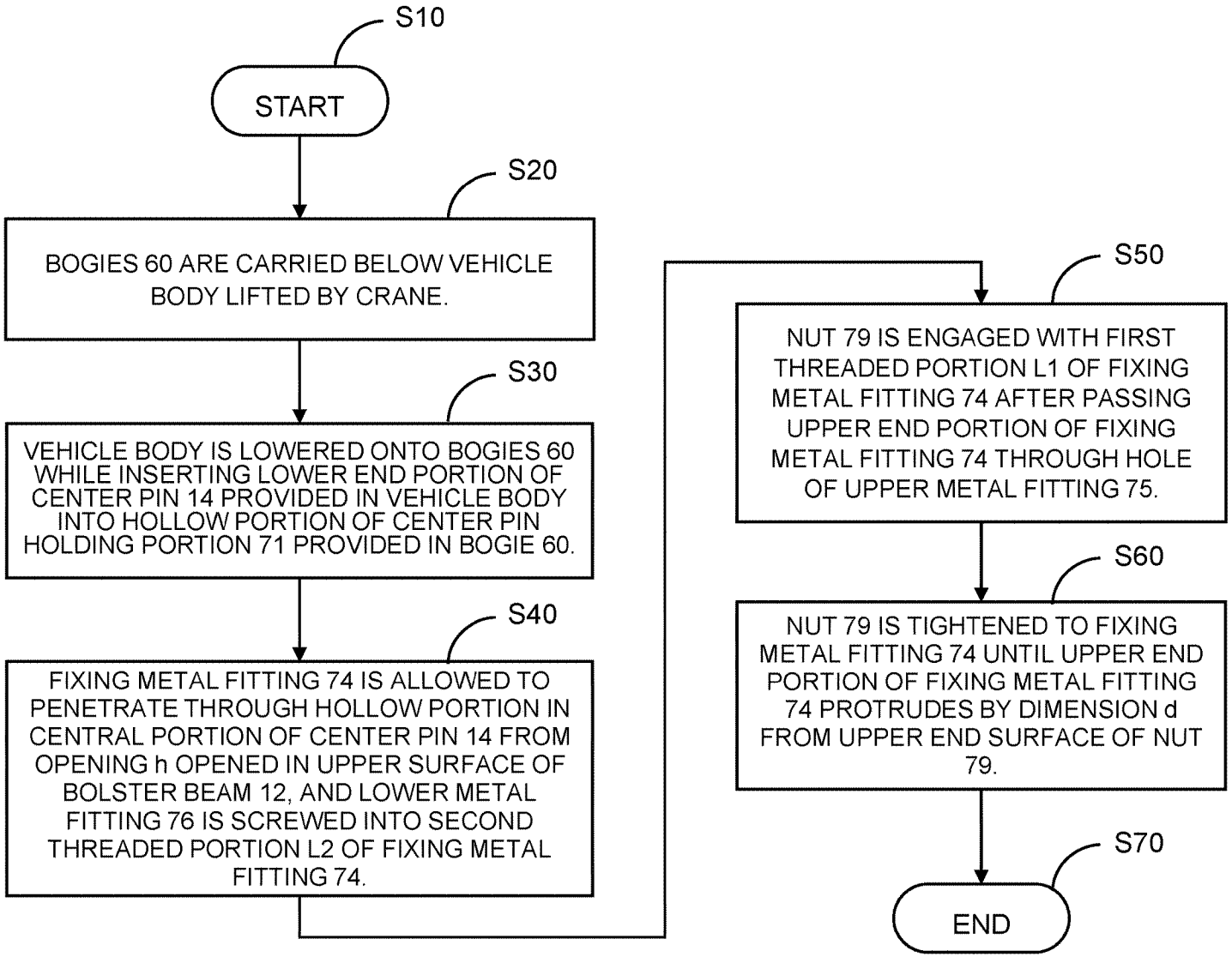
FIG. 6 is a flowchart showing a procedure for assembling the vehicle body to the bogies.

FIG. 6 is a flowchart showing a procedure for assembling the vehicle body to the bogies according to an assembly method of the straddle type monorail vehicle.

First, in S10 (step 10), assembly work is started.

In S20 (step 20), during a manufacturing process of the straddle type monorail, or in a reassembly step after the vehicle body and the bogies 60 are separated from each other during a periodic inspection of the bogies 60 or the like, the bogies 60 are carried below the vehicle body lifted by a crane.

In S30 (step 30), the vehicle body is slowly lowered onto the bogies 60 while the lower end portion (the small cylindrical portion 14*b*) of the center pin 14 provided in the vehicle body being inserted into the hollow portion of the center pin holding portion 71 provided in the bogie 60.

In S40 (step 40), the fixing metal fitting 74 is allowed to penetrate through the hollow portion in a central portion of the center pin 14 from an opening h opened in an upper surface of the bolster beam 12. At this time, since the tapered portion 14*c* is formed between the large cylindrical portion 14*a* and the small cylindrical portion 14*b* of the center pin 14, the fixing metal fitting 74 can smoothly enter the small cylindrical portion 14*b* from the large cylindrical portion 14*a* and pass therethrough by being guided by the tapered portion 14*c*.

The second threaded portion L2 (the male threaded portion) of the fixing metal fitting 74 that penetrates through the center pin 14 is screwed by being threadedly engaged with the female threaded hole 76*a* of the lower metal fitting 76 placed below the center pin holding portion 71. The second threaded portion L2 is tightened by being screwed into the female threaded hole 76*a* until the upper surface of the lower metal fitting 76 abuts against the stepped portion 74*a* at the lower end portion of the fixing metal fitting 74.

In S50 (step 50), the upper metal fitting 75 passes through the opening h to approach the fixing metal fitting 74, and the upper end portion of the fixing metal fitting 74 passes through the hole 75*a* formed in the upper metal fitting 75. Further, after the upper metal fitting 75 is seated on an upper end of the center pin 14, the nut 79 is threadedly engaged with the first threaded portion L1 exposed upward from the upper metal fitting 75.

In S60 (step 60), the nut 79 is tightened by being screwed into the first threaded portion L1 until the upper end portion of the fixing metal fitting 74 protrudes by the dimension d from an upper end surface of the nut 79. At this time, by an axial force (tensile load) generated by the fixing metal fitting 74, the upper surface of the lower metal fitting 76 closely abuts against the lower end of the center pin 14, an outer periphery of the upper surface of the lower metal fitting 76 is biased to closely abut against the lower end of the center pin holding portion 71, and an outer periphery of the lower surface of the upper metal fitting 75 is biased to closely abut against the upper end of the center pin 14.

In S70 (step 70), the assembly work is ended.

Effects of Present Embodiment

Here, when the lower end portion (the small cylindrical portion 14*b*) of the center pin 14 is inserted into the hollow portion of the center pin holding portion 71 provided in the bogie 60, the cushioning rubbers 77 and 78 disposed in the center pin holding portion 71 may become insertion resistance, and the center pin 14 may not reach a specified position in the z direction in the center pin holding portion 71.

On the other hand, according to the present embodiment, after the second threaded portion L2 of the fixing metal fitting 74 is threadedly engaged with the female threaded hole 76*a* of the lower metal fitting 76 and fastened to the end of the stepped portion 74*a*, the upper metal fitting 75 is assembled to the upper end portion of the fixing metal fitting 74 and the nut 79 is fastened by being threadedly engaged with the exposed first threaded portion L1, whereby the fixing metal fitting 74 can be positioned at the specified position in the center pin holding portion 71 via the lower metal fitting 76.

More specifically, when the center pin 14 is temporarily displaced upward in the z direction with respect to the center pin holding portion 71 from the specified position as shown in FIG. 4, a gap is generated between an upper surface of an outer periphery of the lower metal fitting 76 and the lower end of the center pin holding portion 71. Therefore, when the nut 79 is tightened by being threadedly engaged with the upper end portion of the fixing metal fitting 74 from the upper surface of the nut 79, the center pin 14 can be pushed in a direction in which the displacement is corrected using the axial force of the fixing metal fitting 74 against the insertion resistance of the cushioning rubbers 77 and 78, and the upper surface of the outer periphery of the lower metal fitting 76 can closely abut against (be connected to) the lower end of the center pin holding portion 71 (FIG. 3). Further, it is possible to easily confirm that the upper end portion of the fixing metal fitting 74 protrudes by the dimension d from the upper end surface of the nut 79, and for example, by visual observation of a worker, that the center pin 14 is fastened to the center pin holding portion 71 at the specified position in the z direction.

In a state in which a predetermined tensile load acts in the axial direction of the fixing metal fitting 74, the bolster beam 12 that constitutes the underframe 10 and the center pin 14 can be rigidly and reliably fastened to each other with a small number of manufacturing steps via the upper metal fitting 75 and the lower metal fitting 76.

Further, the fixing metal fitting 74 includes the first threaded portion L1 provided at the upper end portion thereof, and the second threaded portion L2 protruding from the stepped portion 74*a* and provided at the lower end portion thereof. The coarse thread is applied to the first threaded portion L1, and the fine thread is applied to the second threaded portion L2. When the fixing metal fitting 74 is made from a cylindrical rod-shaped member, the stepped portion 74*a* provided at the lower end portion is processed, and then the fine thread can be processed and formed in the stepped portion 74*a*.

Therefore, although an outer diameter of the stepped portion 74*a* is small, as compared with a coarse thread having the same size, the stepped portion 74*a* includes a fine thread whose effective diameter is large, so that an effective cross-sectional area of the second threaded portion L2 can be increased, and a straddle type monorail vehicle including the fixing metal fitting 74 that is strong against an external force in a shearing direction and that has higher safety can be provided.

Instead of using the stepped portion 74*a* having a slightly small outer diameter, a flange may be attached to the end portion of the fixing metal fitting 74 to simulate the stepped portion. When the flange is provided, since the outer diameter is not small, higher strength can be maintained.

As described above, according to the straddle type monorail vehicle having the above-described configuration, it is possible to provide a straddle type monorail vehicle in which a center pin provided in a vehicle body can be mechanically fastened to a center pin holding portion provided in a bogie via cushioning rubbers with a small number of work steps, and a method for fastening the vehicle to the bogie.

REFERENCE SIGNS LIST

1: monorail vehicle
5: track beam
10: underframe
12: bolster beam
14: center pin
14*a*: large cylindrical portion
14*b*: small cylindrical portion
14*c*: tapered portion
14*d*: hollow portion
20: side structure
22: side skirt
30: end structure
40: roof structure
42: air-conditioning device
60: bogie
61: air spring
62: bogie cover
63: traveling wheel
64: guide wheel
65: stabilization wheel
66: bogie frame
67: main electric motor
68: speed reducer
69: auxiliary wheel
70: damper
71: center pin holding portion
72: left-right direction cushioning rubber
73: front-rear direction cushioning rubber
74: fixing metal fitting
74*a*: stepped portion
75: upper metal fitting
75*a*: hole
76: lower metal fitting
76*a*: female threaded hole

77, 78: cushioning rubber
79: nut
80: space
d: protrusion amount (control dimension)
h: opening
L1: first threaded portion (coarse thread)
L2: second threaded portion (fine thread)
x: longitudinal (trajectory) direction
y: width direction
z: height direction

The invention claimed is:

1. A straddle type monorail vehicle comprising:

a vehicle body including a center pin fixed in a mode of being suspended from a bolster beam forming a floor portion;

a bogie including a center pin holding portion into which a lower end portion of the center pin is inserted in order to support the vehicle body; and a fixing metal fitting, a lower metal fitting, and an upper metal fitting configured to fasten the center pin to the center pin holding portion, wherein the center pin has a hollow shape in which both ends are opened, and includes a large cylindrical portion on the bolster beam side and a small cylindrical portion that is connected to the large cylindrical portion and that is coaxial with the large cylindrical portion, wherein the center pin holding portion is elastically supported by a bogie frame forming a frame body of the bogie, and has a hollow portion into which the small cylindrical portion of the center pin is inserted, wherein the fixing metal fitting has a cylindrical rod shape inserted through the center pin, includes a first threaded portion at an upper end portion thereof, and includes a second threaded portion at a stepped portion formed at a lower end portion thereof, wherein the lower metal fitting abuts a stepped portion of the center pin holding portion and is flush with a lower surface of the center pin holding portion, and has a female threaded hole to be threadedly engaged with the second threaded portion, wherein the upper metal fitting is disposed within the bolster beam and disposed on an upper end surface of the center pin, and has a hole through which the first threaded portion penetrates, and wherein, in a state in which the second threaded portion is threadedly engaged with the female threaded hole and the lower metal fitting abuts against the stepped portion, the lower metal fitting is biased toward a lower end of the center pin and the upper metal fitting is biased toward an upper end of the center pin by threadedly engaging a nut with the first threaded portion that penetrates through the hole.

2. The straddle type monorail vehicle according to claim 1, wherein the first threaded portion of the fixing metal fitting includes a coarse thread, and the second threaded portion of the fixing metal fitting includes a fine thread.

3. The straddle type monorail vehicle according to claim 1, wherein in the center pin, a hollow tapered portion is disposed between the large cylindrical portion and the small cylindrical portion.

4. An assembly method of the straddle type monorail vehicle according to claim 3, the assembly method comprising:

a step of allowing the fixing metal fitting to penetrate through the center pin from an opening formed in the bolster beam, and threadedly engaging the second threaded portion with the female threaded hole of the lower metal fitting;

a step of threadedly engaging the nut with the first threaded portion after passing the first threaded portion of the fixing metal fitting through the hole of the upper metal fitting; and a step of tightening the nut until an upper end portion of the fixing metal fitting protrudes by a predetermined dimension from an upper end surface of the nut.

5. The straddle type monorail vehicle according to claim 1, wherein an annular or tubular cushioning rubber is interposed between the center pin and the center pin holding portion.

6. An assembly method of the straddle type monorail vehicle according to claim 5, the assembly method comprising:

a step of allowing the fixing metal fitting to penetrate through the center pin from an opening formed in the bolster beam, and threadedly engaging the second threaded portion with the female threaded hole of the lower metal fitting;

a step of threadedly engaging the nut with the first threaded portion after passing the first threaded portion of the fixing metal fitting through the hole of the upper metal fitting; and a step of tightening the nut until an upper end portion of the fixing metal fitting protrudes by a predetermined dimension from an upper end surface of the nut.

7. An assembly method of a straddle type monorail vehicle, comprising:

allowing a fixing metal fitting to penetrate through a center pin from an opening formed in a bolster beam, and threadedly engaging a second threaded portion with a female threaded hole of a lower metal fitting;

a step of threadedly engaging a nut with a first threaded portion after passing the first threaded portion of the fixing metal fitting through the hole of an upper metal fitting;

disposing the upper metal fitting within the bolster beam;

abutting the lower metal fitting against a stepped portion of a center pin holding portion;

a step of tightening the nut until an upper end portion of the fixing metal fitting protrudes by a predetermined dimension from an upper end surface of the nut.

8. The assembly method of the straddle type monorail vehicle according to claim 7, the assembly method comprising:

a step of allowing the fixing metal fitting to penetrate through the center pin from an opening formed in the bolster beam, and threadedly engaging the second threaded portion with the female threaded hole of the lower metal fitting;

a step of threadedly engaging the nut with the first threaded portion after passing the first threaded portion of the fixing metal fitting through the hole of the upper metal fitting; and a step of tightening the nut until an upper end portion of the fixing metal fitting protrudes by a predetermined dimension from an upper end surface of the nut.

* * * * *